73-151 SR
4/5/77 OR 4,015,469

United States Patent [19]
Womack et al.
[11] 4,015,469
[45] Apr. 5, 1977

[54] PUMP-OFF MONITOR FOR ROD PUMP WELLS

[75] Inventors: Fred A. Womack, Humble; Daniel F. Jahns, Houston, both of Tex.

[73] Assignee: Shell Oil Company, Houston, Tex.

[22] Filed: July 2, 1976

[21] Appl. No.: 701,774

[52] U.S. Cl. ..... 73/151
[51] Int. Cl.² ..... E21B 47/00
[58] Field of Search ..... 73/151, 133 R, 168, 73/141 R

[56] References Cited

UNITED STATES PATENTS

| | | | |
|---|---|---|---|
| 2,107,151 | 2/1938 | Higginson | 73/168 X |
| 2,767,578 | 10/1956 | Scarth | 73/168 |

*Primary Examiner*—Jerry W. Myracle

[57] ABSTRACT

An improved method for determining when a rod pumped well has pumped-off wherein the energy input to the polished rod is determined for a portion of the pump stroke and the variation in the computed energy input between pump strokes is used as an indication of the well pumping-off.

2 Claims, 1 Drawing Figure

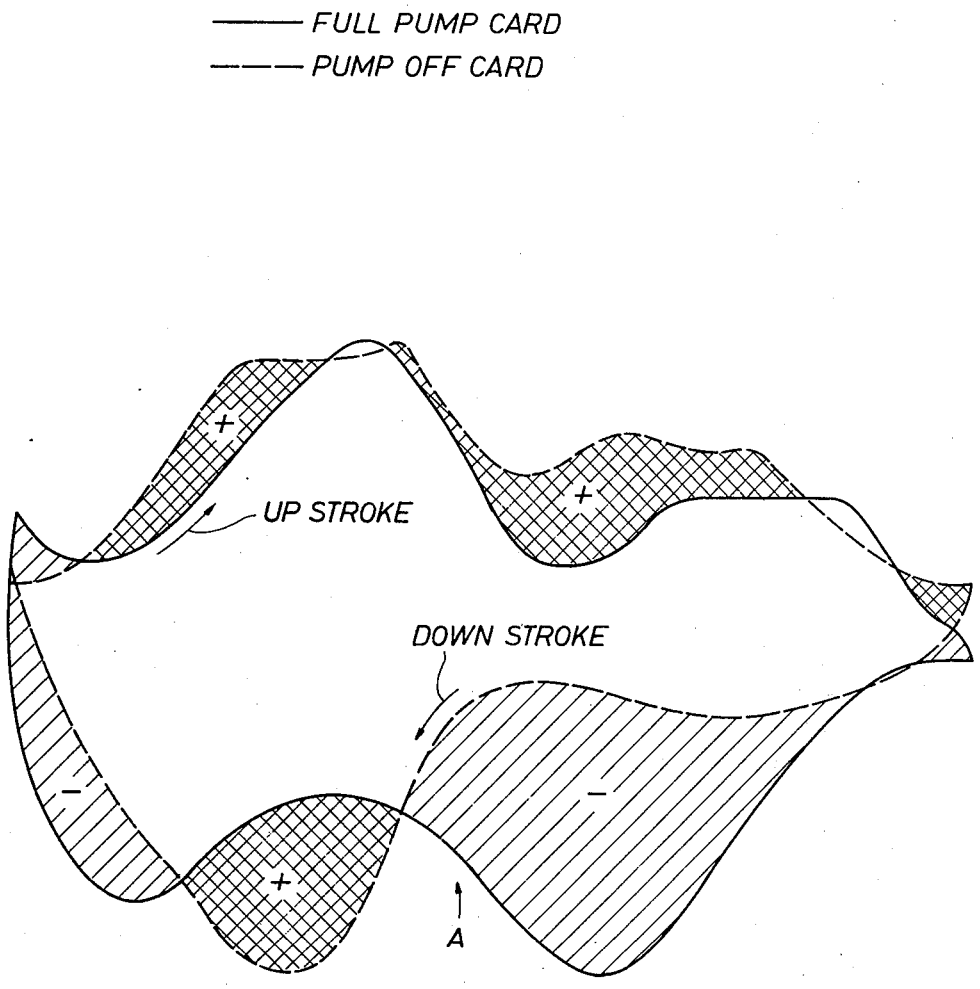
FULL PUMP CARD
PUMP OFF CARD
+
+
UP STROKE
DOWN STROKE
−
−
+
A

PUMP-OFF MONITOR FOR ROD PUMP WELLS

RELATED PATENT APPLICATIONS

The present application is closely related in U.S. Pat. No. 3,951,209 issued to S. G. Gibbs entitled, METHOD FOR DETERMINING THE PUMP-OFF OF A WELL.

BACKGROUND OF THE INVENTION

The present invention relates to the production of petroleum and in particular to the control of beam pumping units used for producing petroleum. In particular, the invention pertains to the control of beam pumping units wherein a pump located at the bottom of the well is actuated by a string of steel sucker rods that are reciprocated by a beam pumping unit at the surface. In this type of pumping unit, it is desirable to shutdown the unit when the pump barrel does not completely fill with liquid on the upstroke of the pump. When the pump barrel does not completely fill with liquid on the upstroke, on the succeeding downstroke, the pump plunger will travel some distance before it contacts the liquid in the pump barrel. This will produce pounding in the pump with severe mechanical stresses and vibrations. The mechanical vibration and stresses lead to premature pump failures and excessive maintenance of the rods and pumping units. Thus, various systems such as those described in the above patent have been designed to determine when the pump barrel has failed to completely fill with liquid. If the pump barrel does not completely fill with liquid on the upstroke, the well is said to have "pumped-off" and the well should be shut-in until sufficient liquid has drained into the well.

As described in the co-pending application, the time when a well has pumped-off may be determined by measuring the energy input to the top of the rod string. The energy input is determined by measuring the load on the rod and the displacement of the rod and integrating the product of the load times displacement. A plot of load versus displacement provides a surface dynamometer card whose area is equal to the total energy input during one stroke of the pump. When the well is pumped-off the energy input to the rod is reduced since the load on the pump plunger on the initial part of the downstroke remains high as a result of the column of oil above the traveling valve and the lack of oil in the pump barrel. The net effect is a reduction in the energy input to the well that can be used to signal the pumping-off of the well.

While the system described in the co-pending application has been used successfully in many cases, the difference between the energy input for a pumping condition and the energy input for a pumped-off condition is usually only 5–15% of the total power input. Thus, errors in the measurement of the load on the rod string or the displacement of the rod string can produce an error in the final result which may substantially equal the difference in energy input between the pumped-off condition and the pumping condition.

BRIEF DESCRIPTION OF THE INVENTION

The present invention is an improvement of the method for determining the pumping-off of a well described in the above referenced patent. In particular, the present invention is based on the discovery that there is a considerable difference in energy input to the pump between a pumped-off and a pumping condition during a portion of the pump stroke. In particular the measured difference occurs during the upper quarter of the pump stroke including both the last quarter of the upstroke and the immediately following quarter of the downstroke. On the upstroke of the pump plunger the traveling valve in the plunger closes and the plunger lifts the column of fluid above the plunger while drawing fluid from the reservoir into the pump barrel. On the downstroke the traveling valve opens while the valve in the barrel closes allowing the fluid in the barrel to pass through the plunger to be lifted on the succeeding upstroke. When the pump barrel beneath the traveling valve is not completely filled with fluid, the energy required to lift the fluid load on the upstroke of the pump is largely cancelled by the gravitational pull of the column of fluid on the resulting downstroke. This is appreciated when one considers that the traveling valve on the pump does not open to release the gravitational pull of the fluid until the pump plunger reaches the liquid level in the pump barrel. Thus, the load on the rod string remains high during the initial portion of the downstroke. Since the load on the rod string remains high during the last quarter of the upstroke and the first quarter of the downstroke, the energy input to the pump will be substantially reduced.

In constrast, when the well is pumping the load on the rod string during the initial quarter of the downstroke will be reduced since the pump barrel is filled with fluid. This, as it flows through the traveling valve, will partially support the column of fluid above the plunger. The reduced load on the rod string will increase the energy input to the well during upper part of the pump stroke.

The present invention utilizes the above occurrence to determine pump-off condition by determining the energy input to the well during only the upper portion of the pump stroke equally divided on either side of the top of the pump stroke. The total energy input to the well during the upper portion of the stroke is determined and compared with the energy input which had previously been determined for the well in a full-pumping condition. When the difference between the two energy inputs varies by more than the predetermined amount, the well is said to be pumped-off.

BRIEF DESCRIPTION OF THE DRAWING

The present invention will be more easily understood from the following description of preferred embodiment when taken in conjunction with the attached drawing showing surface dynamometer cards for a rod pumped well in both a pumped-off and a full pump condition.

PREFERRED EMBODIMENT

In a rod pumped oil well, the pump is located at the bottom of the well and is reciprocated by means of a rod string which extends to the surface. At the surface the rod string is connected to one end of a beam which is pivoted at its center. The beam in turn is reciprocated by a prime mover which may be either an electric motor or an internal combustion engine. The system is also provided with a counter weight means to partially compensate for the weight of the rod string extending into the well. The pump barrel beneath the traveling valve is filled on the upstroke and the liquid in the pump barrel moves through the traveling valve on the downstroke to be lifted to the surface on the next downstroke. When sufficient liquid is available the pump completely fills on the upstroke and the transition from the upstroke to the downstroke is smooth and no undue vibration or pounding in the rod string or the pumping unit is experienced. When sufficient liquid is not available the pump barrel beneath the traveling valve does not completely fill on the upstroke and on the succeeding downstroke, the pump plunger will travel free and build-up a considerable velocity before it contacts the liquid. When the contact with the liquid occurs it will produce severe pounding and vibration in the pumping unit.

The present practice for avoiding the pounding and vibrations when a well pumps-off has been to cycle the pumping units so that they are shut down when the well pumps-off. Normal practice is to periodically test the well to determine how much time is required for the well to be pumped-off and then set the timing mechanism for the prime mover so that it operates only for the time required.

If the production of fluid in the well remained constant, the time cycle method of operating the pumping unit would be satisfactory. As explained in the co-pending application this very seldom occurs and it is desirable to have some means which detects the pumping-off of the well and shuts-in the pumping unit before damage is done. A variable control means is particularly important in fields where water flooding or similar secondary recovery measures are in the process. When a secondary recovery system is in progress, the pump units normally will be larger than required in anticipation of the production of increased amounts of liquid as the secondary recovery process progresses. Thus in the early stages of a waterflood when reduced amounts of liquid are produced, the pumping units must be shut down at frequent intervals.

Referring to the attached drawing, there is illustrated surface dynamometer cards for a rod pumped well in both a full-pump condition and a pumped-off condition. By an inspection, one can observe that when the dotted area is subtracted from the cross-hatched area the difference is small. This difference represents the difference in the total energy supplied to the rod at the surface during a complete stroke of the pump for a full-pump and pumped-off condition. While the overall difference in energy input to the rod string at the surface is small between a full-pump and a pumped-off condition, the difference in the upper half, say, of the stroke, indicated by those areas to the right of point A in the attached figure, is considerable. Based on this discovery, the present invention is directed to measuring the energy input to the rod at the surface during this limited portion of the pump stroke. This energy input can be computed by utilizing the formula disclosed in the above referenced patent. The integration will be performed only over an interval which extends equally in displacement on either side of the top of the stroke. Once the integration is performed, the energy input over that interval can be compared with a previous reading which has been determined as being the normal energy input over the same interval for the well in a full-pump condition. The normal energy input for the well can be determined by averaging a number of the 30 highest energy input readings to the well. This will provide an average energy input for the full-pump condition. The system can then be adjusted to signal the pumped-off condition whenever the energy input falls a certain amount below this input.

The method of the present invention for determining when the well has been pumped-off can be utilized in the control system described in the above patent. Also, the system can be used in various computer control systems being proposed for controlling all the pumping units in an oil field. All of these systems depend basically on determining when the various wells are pumped-off to shut in the wells and control production. This permits the systems to increase the production while minimizing the expense of producing the oil.

We claim as our invention:

1. A method for monitoring a rod pumped well to determine when the well pumps-off by measuring the load on the rod and the displacement of the rod and then integrating the load versus displacement to obtain the energy input to the rod, the improvement comprising:

integrating the load versus displacement measurements over an interval that extends equally in displacement on either side of the top of the pump stroke; and determining when the well pumps-off by comparing the integrated values to detect when the integrated value decreases.

2. The method of claim 1 and in addition, determining when the well pumps-off by comparing said integrated value with the average value of plurality of previously obtained maximum values of the integration previously obtained.

* * * * *